United States Patent [19]

Kiziah

[11] Patent Number: 4,827,539

[45] Date of Patent: May 9, 1989

[54] ADJUSTABLE CLOSET FLOOR FLANGE

[76] Inventor: Floyd G. Kiziah, 501 N. 44th Ave., Hollywood, Fla. 33021

[21] Appl. No.: 140,571

[22] Filed: Jan. 4, 1988

[51] Int. Cl.[4] ..... E03D 11/16; F16L 39/04

[52] U.S. Cl. ..... 4/252 R; 4/DIG. 7; 285/303; 285/320; 285/58

[58] Field of Search ..... 4/252 R, DIG. 7; 285/42, 56, 58, 64, 298, 303, 320, 921

[56] References Cited

U.S. PATENT DOCUMENTS

| | | | |
|---|---|---|---|
| 853,515 | 5/1907 | Lyons . | |
| 872,331 | 12/1907 | Dreier . | |
| 903,280 | 11/1908 | Farrell . | |
| 1,805,816 | 5/1931 | Fleming | 285/42 |
| 2,626,674 | 1/1953 | Boosey | 285/42 |
| 2,672,205 | 3/1954 | McDonald | 285/42 |
| 4,090,267 | 5/1978 | Cuschera | 4/288 |
| 4,214,728 | 7/1980 | Fleisher | 285/320 |
| 4,235,229 | 11/1980 | Ranford et al. | 128/207.17 |
| 4,574,402 | 3/1986 | Brown, Sr. | 4/252 R |
| 4,648,139 | 3/1987 | Stokes | 4/252 R |

*Primary Examiner*—Henry J. Recla
*Assistant Examiner*—J. Casimer Jacyna
*Attorney, Agent, or Firm*—Oltman and Flynn

[57] ABSTRACT

Adjustable fixture and closet floor flange having an upper flange part with an upper flange; a downward facing rib section which has circular horizontal ribs joined by vertical ribs, which are connected with the upper flange. It also has a lower flange part with a lower flange and an upstanding cylindrical collar for receiving the rib section. A number of resilient retaining fingers are attached to the lower part and have retainers that fit into matching spaces in the rib section for locking the upper and lower section together at an adjustable height. The invention also includes a fixture and closet floor flange having key hole slots with optional base floor for holding closet bolts upright with the use of clips, and a fixture flange adaptable to additionally attach a tub box having projecting fasteners for attachment to either an adjustable fixture flange or nailed to a surface separately.

4 Claims, 3 Drawing Sheets

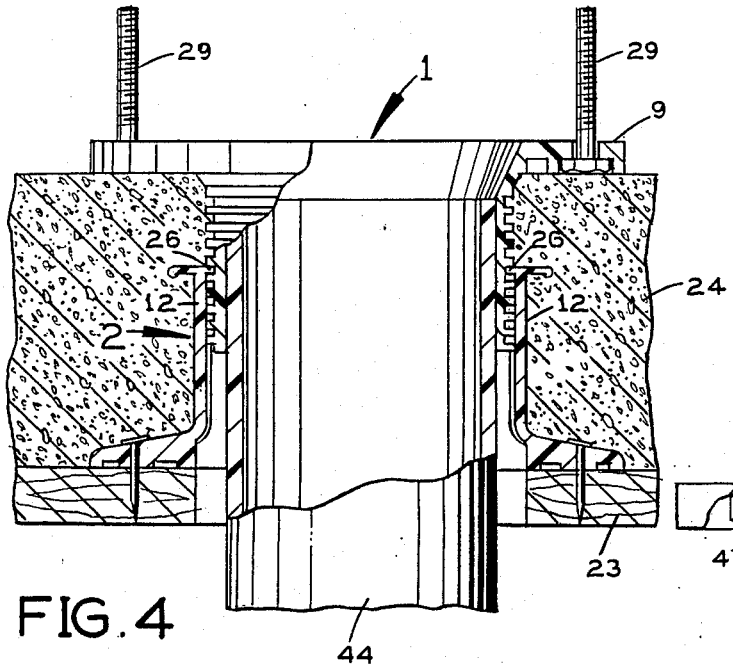
FIG. 4
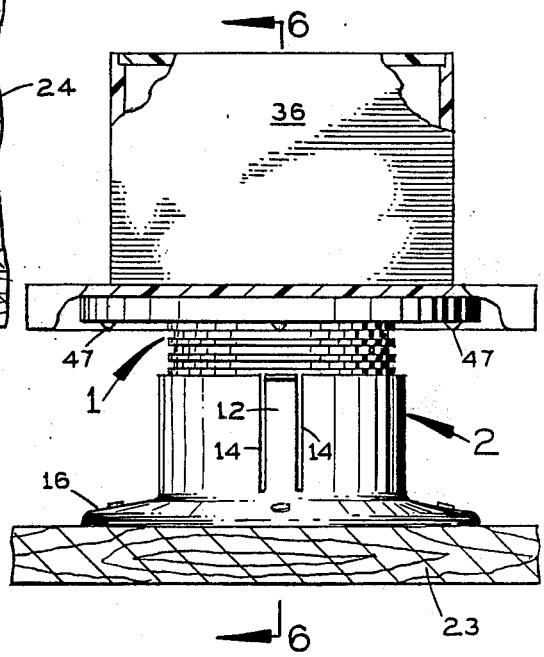
FIG. 5
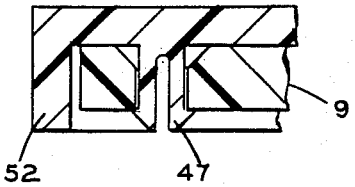
FIG. 7
FIG. 6
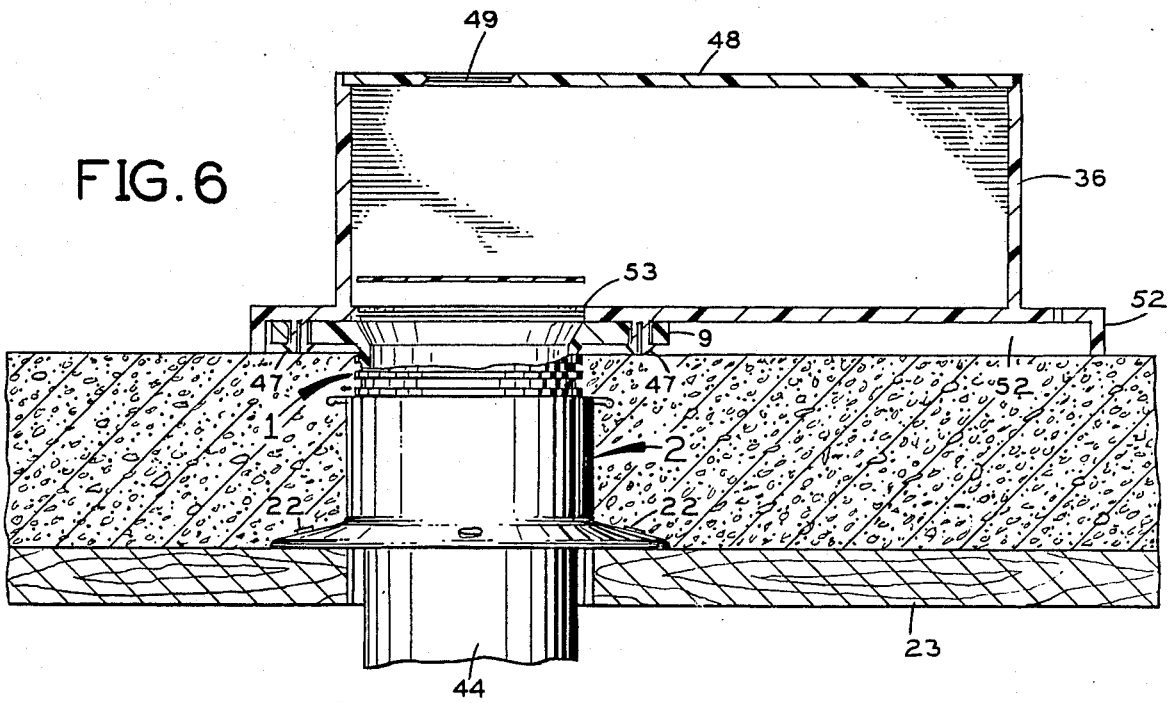

ADJUSTABLE CLOSET FLOOR FLANGE

The instant invention relates to floor drain flanges and more particularly to an adjustable closet floor flange that can be adjusted to different floor thicknesses.

BACKGROUND OF THE INVENTION

In plumbing installations there is usually provided a plumbing closet floor flange attached to the floor, which to one side is connected to an outgoing drain pipe, and to the other side connected to the drain outlet of a fixture such as a toilet, bath tub or the like.

According to the prior art, the drain pipe usually comes from below the floor through an opening in the floor and is terminated in a flange, adapted at the upper side for attachment to the respective fixture and has holes for receiving screws or bolts for attaching the flange to the floor and the fixture.

Fixture flanges according to the prior art have the drawback that they can only with difficulty be attached to the floor. Fixture flanges according to the prior art also have the drawback that they can only with difficulty be attached to concrete floors. They should be made immovable so as to prevent leaks at the point where the flange and the fixture join. This is, for example, the case when a toilet must be attached to the flange. The conventional floor drain flanges have the additional drawback that they can only be adjusted with great difficulty to floors having different thicknesses.

SUMMARY OF THE INVENTION

It is a primary object of the instant invention to overcome the drawbacks of the known closet flanges, in particular in regard to providing adjustability of the flange for different floor thicknesses.

According to the instant invention, there is provided an adjustable closet flange which includes an upper flange part which has an upper flange and a downward facing rib section which has a plurality of circular ribs that are spaced apart in the vertical direction joined together by vertical ribs. The rib section is connected to the upper flange, and a cylindrical hole or drain opening is formed through the upper flange and the rib section; and a lower flange part, which has a flange to be attached to the underside of the floor and an upstanding cylindrical collar connected to the lower flange which has an inner bore adapted to receive the rib section in a sliding fit. The collar has at least one resilient retaining finger attached to the collar on the lower flange and has an inwardly projecting retainer that can be received in the space between the circular ribs, so that the upper flange part can be adjustably secured to the lower flange part. The upper flange part is arranged so that the drain outlet of a fixture can be securely attached thereto and the lower flange part is arranged to be joined to the upper end of a drain pipe.

In accordance with a further feature of the invention the upper flange is adapted to receive the drain outlet of a toilet having a bottom flange. For this purpose the upper flange has key slot shaped holes therein which can receive the bolt heads of fastening bolts disposed through holes in the bottom flange.

In accordance with another feature the key slots can have a floor on their underside so that bolts being placed with their heads in the key slots do not drop through the slots prior to pouring concrete or installation of the toilet.

In accordance with another feature the retainers on the retaining fingers are shaped so that they fit in the space between the circular ribs and the vertical ribs, so that the upper flange is prevented from turning in relation to the lower flange yet making it possible to position the flange in correct position for installation.

In accordance with still another feature the circular ribs are formed as a vertical, helical rib and, the bore of the upstanding collar has a barrel opening for receiving the helical rib, so that the rib section of the upper flange part can slide or be screwed vertically downward into the bore of the upstanding collar, to adjust to the greatest concrete thicknesses used in poured floors.

In accordance with a still further feature, a bath tub box is provided which can be attached by suitable attachment means to the upper flange. The bathtub box is arranged to provide an opening in concrete floors of different thicknesses for the installation of tub waste. Tub box may be used by itself when the poured concrete is of a depth of 4" or under.

Further objects and advantages of this invention will be apparent from the following detailed description of a presently preferred embodiment which is illustrated schematically in the accompanying drawings.

BRIEF DESCRIPTION OF THE FIGURES

FIG. 4 is a cross-sectional detail with part of the wall broken away to show the interior of the invention.

FIG. 5 is an elevational view of the invention showing a bath tub box incorporated thereinto.

FIG. 6 is an elevational cross-sectional detail view of the invention seen along the line 6—6 of FIG. 5.

FIG. 7 is a cross-sectional fragmentary detail view of the invention showing an expansion fastener.

DESCRIPTION OF THE PREFERRED EMBODIMENT

Figure 1:
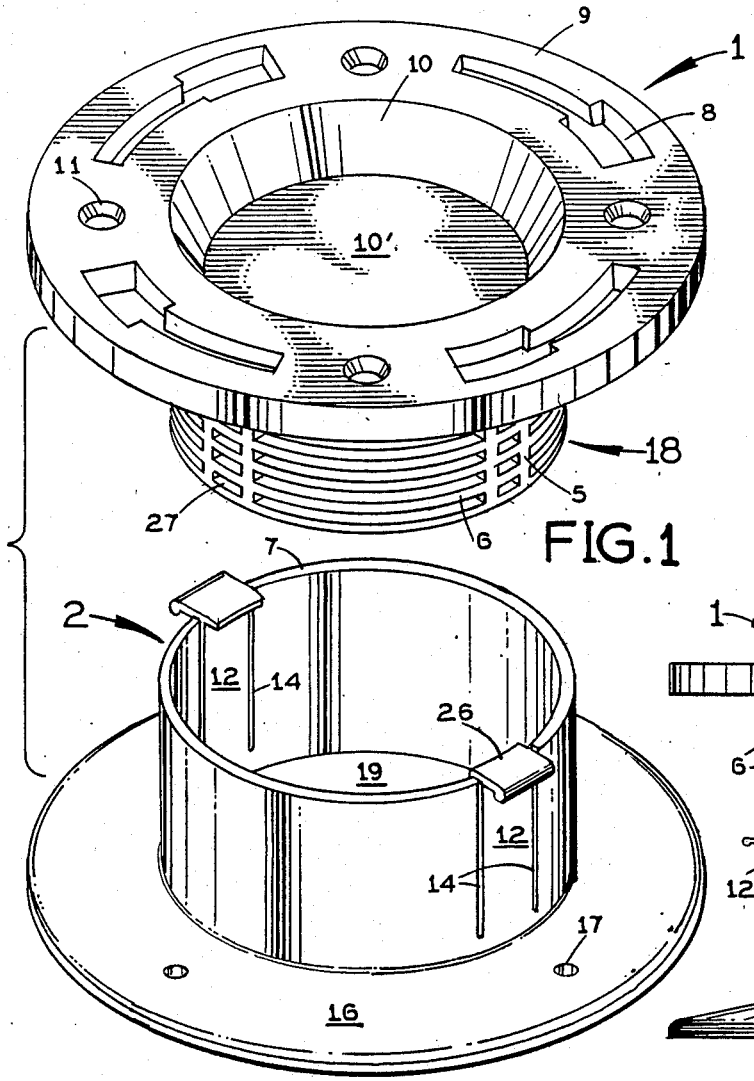
FIG. 1 is an elevational perspective view of the invention showing the upper and lower flange parts.
Figure 2:
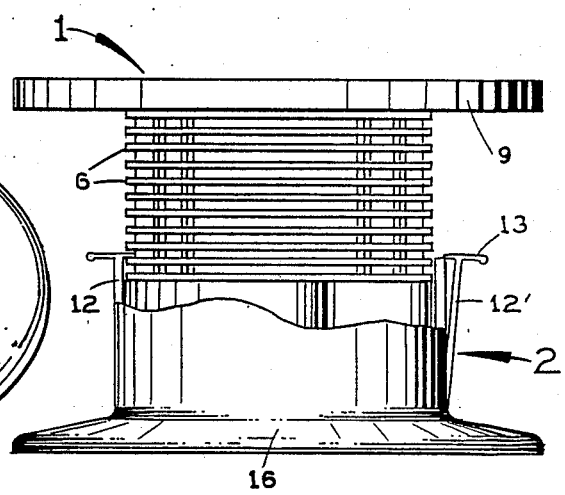
FIG. 2 is an elevational detail view of the invention showing the upper and lower flange part assembled.

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

FIGS. 1–8 show an embodiment of the invention best suited for installing fixtures such as a toilet or the like which must be immovable once concrete is poured in place.

An upper flange part 1 has an upper flange 9 having key slots 8 for receiving bolt heads of the attachment bolts holding the fixture attached to the flange 9. Bolt holes 11 serve to attach the upper flange 9 by means of downward projecting screws or bolts, not shown, to the floor. A conical inner surface 10 serves to help make for more positive waste removal through flange. There is a knockout piece 10' at the bottom of surface 10.

A downward projecting rib section 18, having a plurality of spaced apart circular horizontal ribs 6, joined together by vertical ribs 5, is connected to the underside of the upper flange 9 concentrically therewith.

Figure 3:
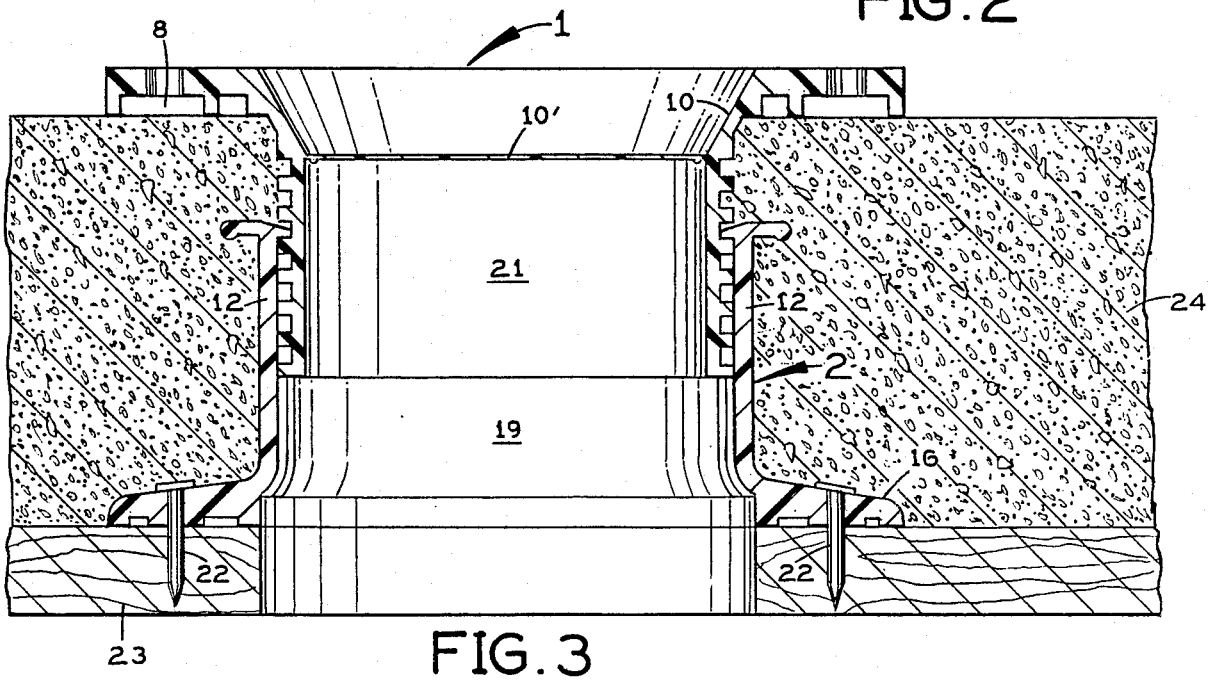
FIG. 3 is an elevational cross-sectional view of the interior of the invention seen embedded in concrete.
Figure 8:
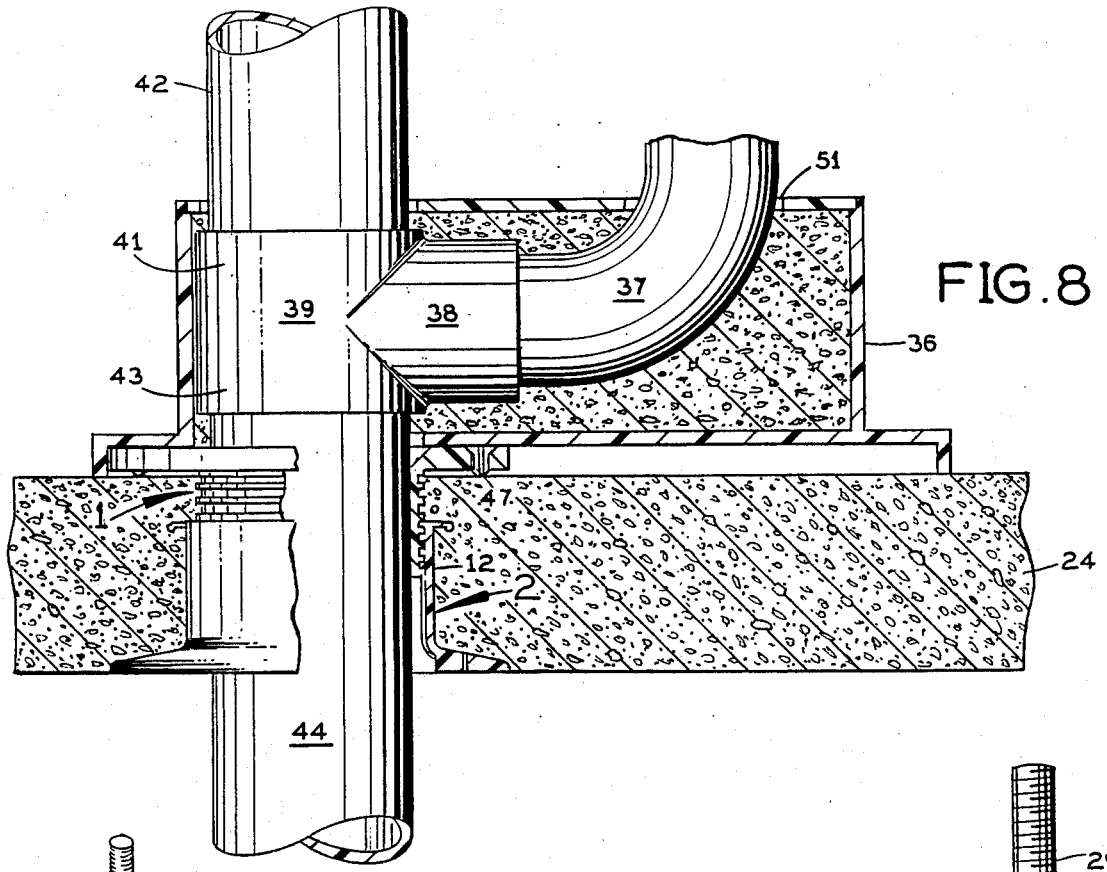
FIG. 8 is an elevational cross-sectional view of the invention showing the interior of a bath tub box.

The lower flange part 2 has a lower flange 16 with nail or screw holes 17 for attaching the flange to the underside of the floor, as best seen in FIG. 3, by means of nails or screws 22, driven into the wood deck 23, before the concrete 24 is poured onto the deck 23.

An upstanding collar 7 is connected to the lower flange 16 concentrically therewith, forming a lower drain opening 19 which continues the upper drain opening 21 in the upper flange section. The collar 7 has an inner bore which slidably receives the rib section 18. At least one resilient retaining finger 12 is formed in the collar, by means of, for example, two vertical finger slots 14 cut or formed in the collar wall. Each retaining finger has at its upper end a radially inward projecting retainer 26 which fits in the space between the horizontal ribs 6. A finger grip 13 is disposed outwardly projecting at the top end of the retaining finger 12. Upon assembling the fixture flange, the retaining fingers 12 are grasped by the finger grips 13 and bent outward as shown at the right hand side of FIG. 2 at bent finger 12', thereby allowing the rib section 18 to slide into the bore 19 of the collar 7. The rib section 18 is in that way inserted into the bore 19 until the underside of the upper flange 9 reaches the level to which the concrete floor 24 is later poured. After the floor 24 has been poured, the upper flange may be secured to the concrete floor by means of lag bolts or other fastening means through the bolt holes 11 in the upper flange 9.

In one advantageous embodiment of the invention, the retainers 26 will fit into spaces 27 formed between the vertical ribs 5 and the horizontal ribs 6 so that the upper flange part 1 is prevented from turning in the bore 19, in relation to the lower flange part 2.

Figure 10:
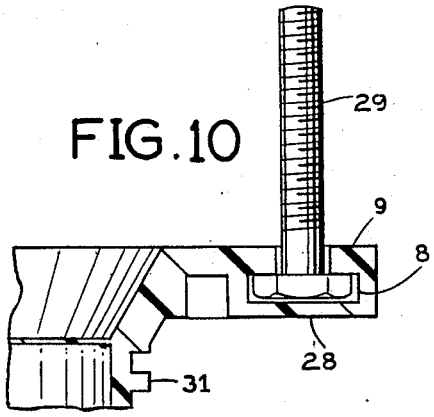
FIG. 10 is an elevational cross-sectional fragmentary detail with part of the wall broken away to show the interior of a keyhole slot seen along the line 10—10 of FIG. 9.

In another embodiment, shown in FIG. 10, the underside of the key slot 8 is covered with a floor 28 so that the fastening bolts 29 are prevented from dropping through the key slot 8 in case the bolt 29 is inserted before the concrete 24 is poured.

Figure 9:
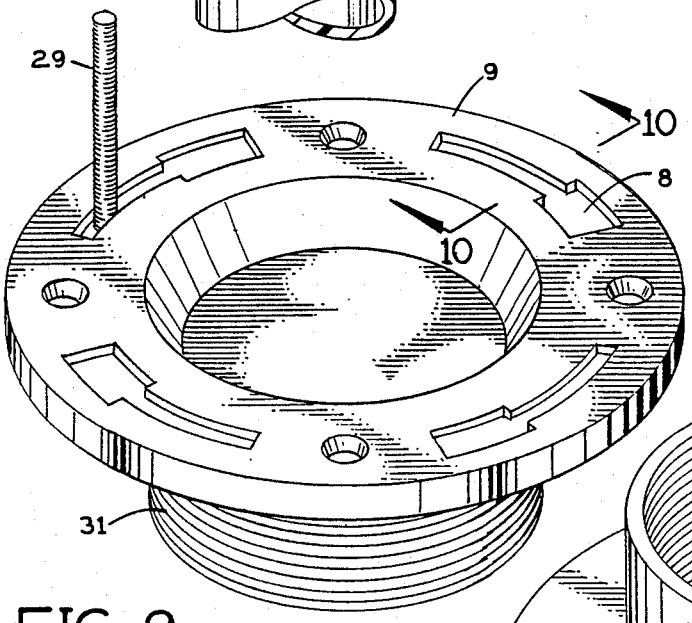
FIG. 9 is an elevational perspective detail view of the invention showing the upper flange part with a helical rib section.
Figure 11:
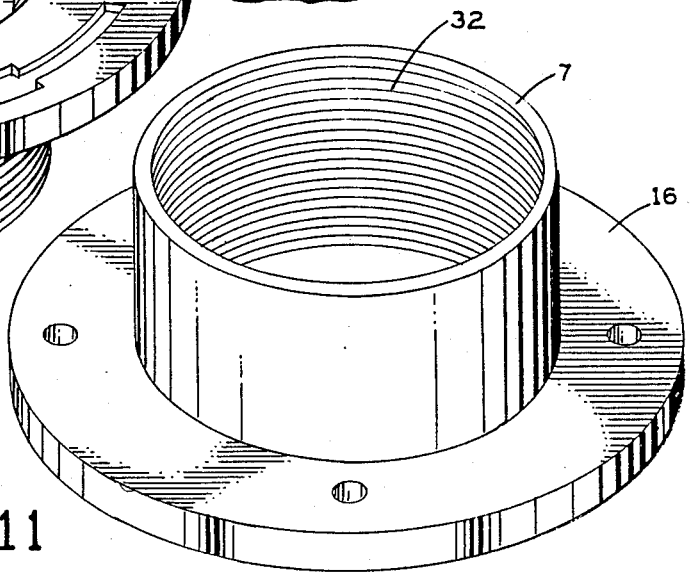
FIG. 11 is an elevational view of the lower flange part having a helical groove in the collar.

In still another embodiment seen in FIGS. 9 and 11 a different rib section is connected to the upper flange 9 in which the horizontal ribs are formed as a continuous helical rib 31. The bore 19 has in this embodiment a mating helical groove 32 that allows the upper flange part to be screwed into the collar 7, so that the separation between the upper and lower flange is infinitely adjustable, by sliding or screwing the upper flange part to an appropriate height. This embodiment may also have key slots with a floor, as described hereinabove.

In still another embodiment seen in FIG. 5–8 showing a bath tub box 36, serving as an opening for a bath tub (not shown) having its outlet connected to the curved drain pipe 37. The latter is in turn connected to one branch 38 of a branch fitting 39 having an upward facing branch 41 connected for example to an upward overflow pipe 42. The branch fitting 39 has a downward facing outlet 43 connected to the downward drain pipe 44. The bath tub box 36 is advantageously a rectangular box having an underside 46 attached by expansion tabs 47 to the bolt holes 11 in the upper flange 9 described hereinabove. The bath tub box has an upper side 48 in the form of a detachable plate having a "knock-out" finger hole 49 for removing the lid and admitting the tub waste.

In the bath tub box embodiment, the downward drain pipe 44 leads directly upward through the lower and upper flange parts 2 and 1 into the branch fitting 39.

The bath tub box 36 may advantageously have a downward facing edge flange 52 (FIG. 6) having a depth slightly thicker than the upper flange 9 for spacing the box from the upper floor surface.

FIG. 7 shows details of the expansion fastener 47 inserted into one of the bolt holes 11 of the upper flange 9.

The bath tub box 36 may advantageously have a "knock-out" hole 53 in the base of the tub box for admitting the tub waste.

I claim:

1. An adjustable closet floor flange comprising: an upper flange part having an upper flange, a downward facing rib section having a plurality of vertically spaced horizontal circular ribs joined by a plurality of vertical ribs, being connected with the upper flange, having a cylindrical drain opening formed through said upper flange and said rib section; a lower flange part having a downward facing lower flange; an upstanding cylindrical collar being connected with said lower flange, having an inner cylindrical bore for downwardly receiving said rib section and for upwardly receiving the upper end of a drain pipe; at least one resilient retaining finger being attached to said lower flange part, having an inwardly projecting retainer being receivable in the space between said horizontal ribs for adjustably securing said upper flange part to said lower flange part; means for connecting said upper flange part to a drain outlet, and the lower flange part to the upper end of a downward drain pipe, wherein said drain outlet is the outlet of a toilet having a bottom flange: and the upper flange includes a key slot formed in said upper flange for receiving a head of a fastening bolt, the bolt having an upper threaded end for receiving a nut serving to secure the toilet bottom flange to said upper flange.

2. An adjustable closet floor flange according to claim 1, including a key slot floor disposed at the underside of said key slot to prevent the fastening bolt from falling through the slot.

3. An adjustable closet floor flange according to claim 1 having bolt holes in the upper flange for attachment to the upper floor surface, and nail holes in the lower flange for attachment to a floor deck.

4. An adjustable closet floor flange according to claim 1 having rotation prevention spaces formed between said horizontal and vertical ribs for receiving said inward projecting retainers.

* * * * *